US006768883B2

(12) United States Patent
Wiegand et al.

(10) Patent No.: US 6,768,883 B2
(45) Date of Patent: Jul. 27, 2004

(54) INTERACTIVE REQUIRED STOCK FAULT RECOVERY METHODOLOGY

(75) Inventors: Michael A. Wiegand, Webster, NY (US); Timothy D. Uetz, Webster, NY (US); Richard J. Eddy, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/231,840

(22) Filed: Aug. 29, 2002

(65) Prior Publication Data

US 2004/0042811 A1 Mar. 4, 2004

(51) Int. Cl.[7] ..... G03G 15/00
(52) U.S. Cl. ..... 399/82; 399/23
(58) Field of Search ..... 399/82, 81, 16, 399/24, 23, 361, 391, 45

(56) References Cited

U.S. PATENT DOCUMENTS 5,061,958 A * 10/1991 Bunker et al. ..... 399/82
5,172,178 A * 12/1992 Oushiden et al. ..... 399/86
5,229,814 A 7/1993 Hube et al. ..... 399/14
5,420,669 A 5/1995 Imada ..... 355/208
6,304,732 B1 * 10/2001 Myers et al. ..... 399/81
6,356,719 B1 3/2002 Yoshiura ..... 399/45
6,606,466 B2 * 8/2003 Sato ..... 399/82

FOREIGN PATENT DOCUMENTS

JP 3-236669 * 10/1991

* cited by examiner

*Primary Examiner*—Quana Grainger
(74) *Attorney, Agent, or Firm*—Christopher D. Wait

(57) ABSTRACT

A method of controlling paper stock fault recovery in an image reproduction system for producing a print job from electronic data in accordance with job requirements calling for a desired stock having one or more selected stock attributes, the system including an interactive user interface enabling a system user to input operating instructions to the system. A dialog is thereby provided in which the operator may query any stock tray and get a listing of those stock tray attributes which are mismatched with the print job desired stock attributes.

19 Claims, 2 Drawing Sheets

INTERACTIVE REQUIRED STOCK FAULT RECOVERY METHODOLOGY

BACKGROUND

The present invention relates generally to image reproduction systems particularly with regards to paper stock selection in printers and copiers. More particularly, this invention relates to guiding customers or operators in the selection of paper stock available in a given machine.

Many conventional image reproducing systems, such as copiers or printers, use multiple stocks. Stocks constitute various printing substrates, such as paper, on which printed matter is printed. Stocks may vary as to thickness, width, length, color, material composition and a plethora of other characteristics.

In many conventional image reproducing systems, an operator must be aware of what stocks are available for use with the system. The operator must manually place the stocks into the paper tray for the system and program the paper tray accordingly. Often times, an operator must take a physical inventory of the stocks that are available in a given print shop in order to be aware of what stocks are available. Unfortunately, a print shop may have 1000 or more items of stock. As such, identifying stocks, determining what stocks to use and programming the paper trays is often cumbersome for an operator.

For some image reproduction systems, much of the identifying and determining of available stock is automated for the operator. However, when there is a failure of a stock attribute match in such a system a media fault indication is provided to the operator. For example, one such system provides about twelve different media attributes that a customer programs on a job and that the printer operator programs on the media loaded into a paper tray. When a job requests a media with attributes that fail to match all attributes on a media loaded into one of the printer's trays, the printer raises a media fault. The operator is then required to manually compare the programmed job and tray media attributes to determine which attributes do not match. With twelve or more media attributes in each list, detecting the differences can be time consuming. It is desirable to minimize the impact of time and the confusion that a multiplicity of such media stock can create for an operator.

In U.S. Pat. No. 5,420,669 to Imada, the invention described discloses a calculation unit for comparing specific paper attributes is stored in a nonvolatile memory with the detection results of cassettes. The unit checks whether the specific paper attributes coincide with the detection results, and calculates the weighted points for each matched item. A selection unit compares the calculated values, to select a paper feed cassette most suitable for the specific paper attributes. The results are arranged to numerically evaluate the paper feed cassettes, in this way preferentially selecting the suitable paper feed cassette. Operation keys for setting specific paper attributes are arranged to change specific paper attributes to be preferentially selected. Therefore, in a power-ON or a paper empty state, paper which is required by a user is preferentially selected from a plurality of paper feed means to decrease operations for selecting paper, thus, improving operability.

In U.S. Pat. No. 6,356,719 to Yoshiura, the invention described discloses an image forming device as a digital composite machine which provides a plurality of image input modes in which image information is inputted in different forms, respectively. The image forming device is provided with (1) feed devices for supplying a plurality of types of recording materials, (2) a display device for displaying information regarding recording materials which are ready to be fed from the feed devices, (3) mode keys for selecting one from among the plurality of image input modes, (4) selecting keys for selecting one recording material on which image information is to be recorded, from among the recording materials displayed by the display device, (5) a recording section for recording image information inputted in the mode selected through the mode keys, onto the recording material selected through the selecting keys, and (6) a CPU for determining information regarding the recording materials to be displayed by the display section, depending on the mode selected. This arrangement ensures that the image forming device is capable of recording for reproduction of inputted images on suitable recording materials, selecting recording materials so as to be suitable to the input modes, respectively, and at every mode setting, displaying and selecting information regarding suitable recording materials in appropriate forms.

In U.S. Pat. No. 5,229,814 to Hube et al., the invention described discloses a process for operating an electronic printing system at a job site for producing print jobs from image signals, the electronic printing system having programming means for inputting printing instructions for the print jobs and a plurality of supply trays for supplying print media, including the steps of: identifying stock characteristics currently available for loading in the print media supply trays when printing the print jobs; identifying stock characteristics potentially selectable but not available at the site for loading in the print media supply trays; mapping individual ones of the unavailable stock characteristics with at least one of the available stock characteristics; on input of a print job, comparing a requested stock characteristic of the print job with the stock characteristics available; and where the requested stock characteristic is unavailable, using the mapping step to substitute a corresponding available stock characteristic for the unavailable, requested stock characteristic.

In U.S. Pat. No. 6,304,732 to Myers et al., the invention described discloses a stock library which contains objects that encapsulate attributes of respective stocks that may be used in an image reproducing apparatus. The objects may include visual representations, such as icons, for representing the stocks. A stock library window may display the icons and selected attributes of the stocks to provide a visual catalog of the stocks that are available to an operator. The visual representations may be dragged and dropped to program paper trays, select stocks for print jobs and provide other behavior.

All of the above are herein incorporated by reference in their entirety for their teaching.

Therefore, as discussed above, there exists a need for a methodology to minimize the impact of decision time and the confusion for an operator, that a multiplicity of media stock, across multiple jobs can create. Thus, it would be desirable to solve this and other deficiencies and disadvantages with an improved methodology for solving stock media faults.

The present invention relates to a method of controlling paper stock fault recovery in an image reproduction system for producing a print job from electronic data in accordance with job requirements calling for a desired stock having one or more selected stock attributes. The method comprises determining if the desired stock having the one or more selected stock attributes is available. If the desired stock is not available, indicate a mismatch, query a stock tray, and display those stock tray attributes which do not match the job requirements.

In particular, the present invention relates to a method of controlling paper stock fault recovery in an image reproduction system for producing a print job from electronic data in accordance with job requirements calling for a desired stock having one or more selected stock attributes, the system including an interactive user interface enabling a system user to input operating instructions to the system. The method comprises determining if the desired stock having the one or more selected stock attributes is available. If the desired stock is not available, indicate a mismatch. Then query a stock tray and display for the queried stock tray those stock tray attributes which do not match the one or more selected stock attributes called for by the job requirements.

The present invention also relates to a method of controlling paper stock fault recovery in an image reproduction system for producing a print job from electronic data in accordance with job requirements calling for a desired stock having one or more selected stock attributes, the system including an interactive user interface enabling a system user to input operating instructions to the system. The method comprises determining if the desired stock having the one or more selected stock attributes is available. Then if the desired stock is determined as not available, opening a pop-up window and indicating a mismatch in the pop-up window as having occurred. This is followed with providing selectable buttons for each stock tray in the pop-up window, so as to allow querying a stock tray, and displaying for the queried stock tray, those stock tray attributes which do not match the one or more selected stock attributes called for by the job requirements.

DESCRIPTION

Herein is proposed a method for simplifying identification of media programming faults on reprographic systems and printers. In one example system, there are provided approximately twelve different media attributes that a customer may program on a job and that the system operator in turn programs on the media loaded into a paper tray. When a given job requests media with attributes which fail to match all attributes for any of the available media loaded into one of the printer's trays, the printer raises a media fault. The operator is then required to manually compare the programmed job and tray media attributes to determine which attributes do not match. With twelve or more media attributes in each list, detecting the differences is time consuming. Solving this operational problem may be particularly elusive, as it is the operator who previously in view of the job requirements typically believes he has properly stocked the media trays in the first place. Having missed a required media attribute the operator needs expeditious and clear feedback to appreciate the nature of the mismatch. The solution provided herein solves this problem by adding tray buttons to the printer job fault dialog. These buttons activate software that compares the job and tray media attributes and highlight the differences. The advantage of this approach is that it is automatic and it simplifies and speeds the process of identifying and correcting tray programming errors. This improves both operator and customer convenience and productivity.

Figure 1:
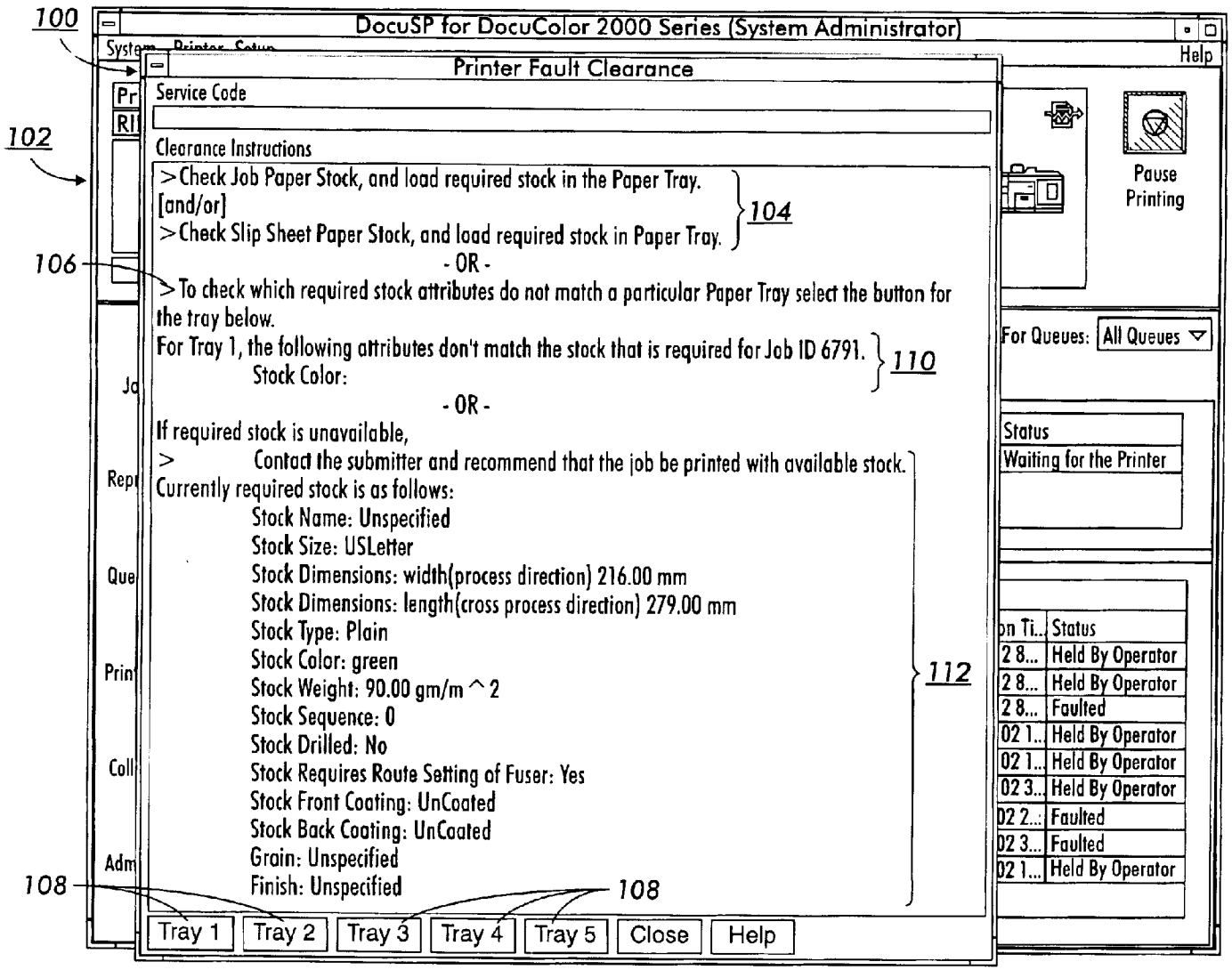
FIG. 1 shows one possible embodiment of a User Interface display with a pop-up screen for practicing the methodology taught herein.

FIG. 1 shows one possible arrangement for a pop-up window 100 embodiment that ascribes to the teachings presented herein. The pop-up 100 is titled "Printer Fault Clearance" and is responsive to a mismatch in the job required stock versus the loaded stock available in any system paper tray. This pop-up 100 is part of the User Interface (UI) 102 and display provided in one embodiment system for communication between the system and the attendant operator, as is further described in U.S. Pat. No. 5,229,814, which is herein incorporated in its entirety for its teachings. It will be appreciated by those skilled in the art that such a pop-up 100, UI 102, and display, constitutes but one possible arrangement for utilizing the teachings provided herein in the communication with a system operator or customer. For example, an arrangement of buttons, sensors, switches, lamps, meters, and other indicators may be employed.

As shown in FIG. 1, there is provided a dialog between system and operator. The initial clearance instructions 104 admonish checking the job-specified paper stock and loading the required stock. However, as an alternative, further instruction 106 is provided suggesting: "To check which required stock attributes do not match a particular Paper Tray select the button for the tray below". Tray buttons 108 are provided in this embodiment in the margin at the bottom of the window. This exemplary arrangement allows the operator to query the system for the stock types the system believes are loaded, simply by clicking the corresponding tray button 108. The fault information update dialog 110 will then indicate those attributes for the selected tray which are at odds with the job required stock attributes. For the example shown in FIG. 1, the system is indicating that the fault mismatch relates to a stock color mismatch. The subsequent response dialog 112 provides the stock required attributes for the current job. This allows the operator to review the requirements in comparison with the known available stock types. This allows the customer/operator to either elect printing with alternate stock, or contact the submitter to suggest resubmitting with an alternate available stock type.

One unexpected benefit of this arrangement has been in allowing operators to recover from their own operator error. For many systems the inherent attributes for the stock residing in a given tray is not actuality sensed directly. Instead tray indicators are set by the operator or customer to indicate to the system the attributes for the stock residing therein. The operator may load up the correct stock yet fail to properly set the tray attribute indicators. Having immediate feedback from the system as discussed above, allows for expeditious human error recovery because it allows the operator to "see" the mismatch.

Figure 2:
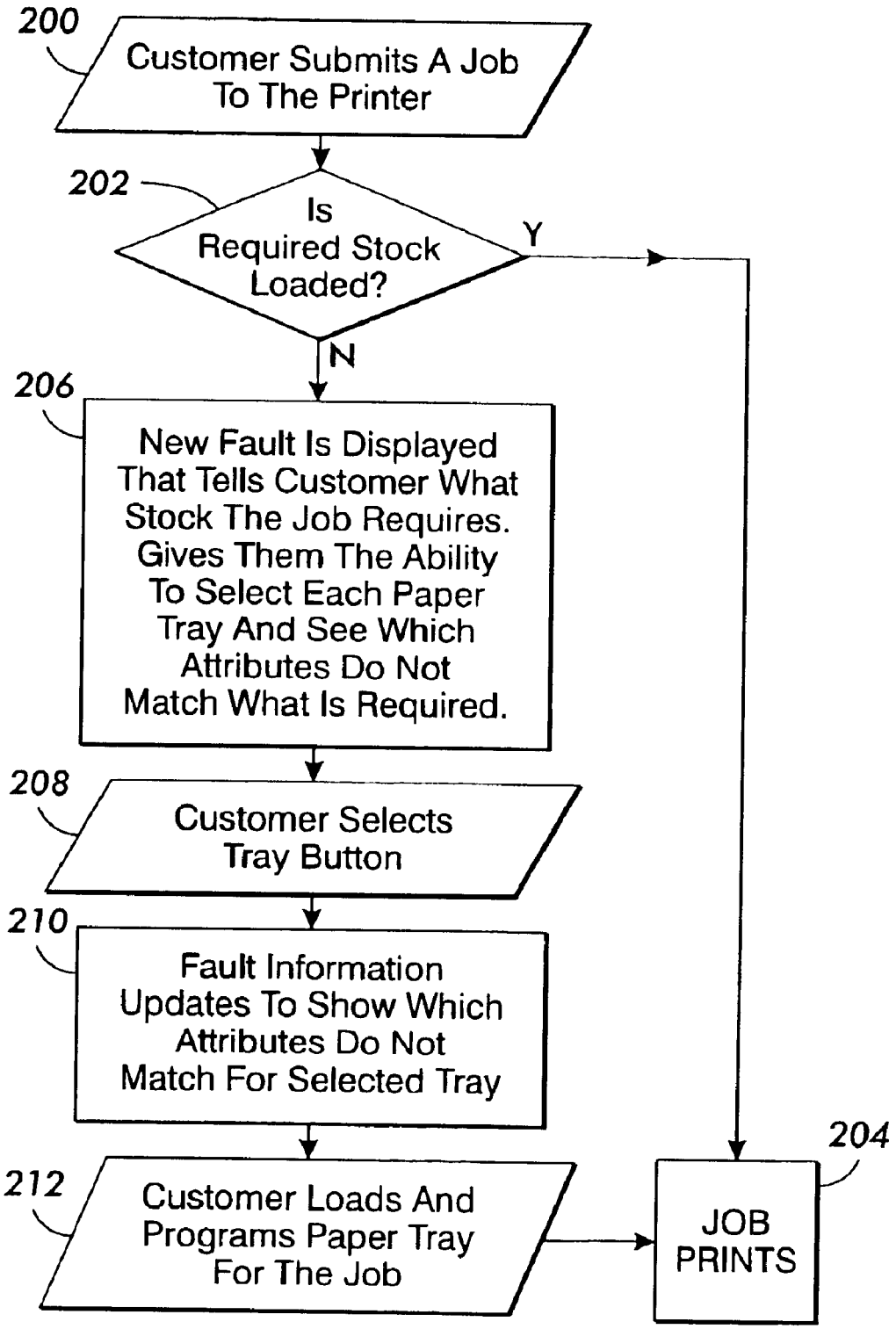
FIG. 2 depicts a flow chart for a method allowing improved interoperability with a system during a stock fault interrupt situation.

In FIG. 2, a flow chart is provided further depicting the teaching disclosed above. The process starts initially with block 200 and the submission of a print job to the printer. At decision block 202 the system makes a determination as to whether the job required stock is loaded and available. If the desired stock is available, the process flow is directed to print the job as depicted with stop block 204. However, if the required stock is not available, the system will indicate that to the customer or operator, and allow a query of the contents of any stock tray as depicted by display block 206. Input block 208 accepts operator selection of a tray button and at output block 210 the fault attributes which do not match are displayed. At input block 212 the appropriate paper tray is loaded, programmed and selected for the job and the job may then be printed as provided at stop block 204.

In closing, by clearly delineating the mismatch in stock attributes as versus the available system stock greatly improves the operational efficiency for a large printer/copier system. In particular, providing the ability for the operator or customer to query for the attributes which the system believes to be associated with the stock in a given tray allows an improved interoperability, ease of use and increased responsiveness to system stock fault scenarios.

While the embodiments disclosed herein are preferred, it will be appreciated from this teaching that various alternative modifications, variations or improvements therein may be made by those skilled in the art. All such variants are intended to be encompassed by the following claims.

What is claimed is:

1. A method of controlling paper stock fault recovery in an image reproduction system for producing a print job from electronic data in accordance with job requirements calling for a desired stock having one or more selected stock attributes, comprising:

determining if the desired stock having the one or more selected stock attributes is available;

indicating a mismatch if desired stock is not available;

querying a stock tray; and, displaying those stock tray attributes which do not match the job requirements.

2. The method of claim 1 wherein the image reproduction system includes an interactive user interface.

3. The method of claim 2 further comprising: providing tray buttons for selecting which stock tray is to be queried.

4. The method of claim 3 further comprising: displaying the selected stock attributes for the print job.

5. The method of claim 4 further comprising:

querying an alternative stock tray; and, displaying those alternative stock tray attributes which do not match the job requirements.

6. The method of claim 2 wherein the indicating a mismatch includes opening a pop-up window.

7. The method of claim 1 further comprising subsequent to querying a stock tray:

selecting a stock tray; and, printing the job with the stock in the selected stock tray.

8. A method of controlling paper stock fault recovery in an image reproduction system for producing a print job from electronic data in accordance with job requirements calling for a desired stock having one or more selected stock attributes, the system including an interactive user interface enabling a system user to input operating instructions to the system, comprising:

determining if the desired stock having the one or more selected stock attributes is available;

indicating a mismatch if desired stock is not available;

querying a stock tray; and, displaying for the queried stock tray those stock tray attributes which do not match the one or more selected stock attributes called for by the job requirements.

9. The method of claim 8 further comprising: providing tray buttons for selecting which stock tray is to be queried.

10. The method of claim 9 further comprising: displaying the selected stock attributes called for by the print job requirements.

11. The method of claim 10 further comprising:

querying an alternative stock tray; and, displaying those alternative stock tray attributes which do not match the job requirements.

12. The method of claim 8 further comprising that subsequent to the querying a stock tray:

selecting a stock tray; and, printing the job with the stock in the selected stock tray.

13. The method of claim 10 wherein the indicating and displaying are provided by the interactive user interface via a pop-up window.

14. A method of controlling paper stock fault recovery in an image reproduction system for producing a print job from electronic data in accordance with job requirements calling for a desired stock having one or more selected stock attributes, the system including an interactive user interface enabling a system user to input operating instructions to the system, comprising:

determining if the desired stock having the one or more selected stock attributes is available;

opening a pop-up window if the desired stock is determined as not available;

indicating a mismatch in the pop-up window as having occurred;

providing selectable buttons for each stock tray in the pop-up window;

querying a stock tray; and, displaying for the queried stock tray, those stock tray attributes which do not match the one or more selected stock attributes called for by the job requirements.

15. The method of claim 14 further comprising: displaying a complete list of the selected stock attributes called for by the print job requirements.

16. The method of claim 15 further comprising:

querying an alternative stock tray; and, displaying those alternative stock tray attributes that do not match the selected stock attributes called for by the job requirements.

17. The method of claim 16 further comprising that subsequent to querying a stock tray the following steps are provided:

selecting a stock tray; and, printing the job with the stock in the selected stock tray.

18. The method of claim 17 further comprising contacting the print job originator to suggest resubmitting the job.

19. The method of claim 17 further comprising restarting the print job with a reloaded stock tray.

* * * * *